US006684515B1

(12) United States Patent
Clark

(10) Patent No.: US 6,684,515 B1
(45) Date of Patent: Feb. 3, 2004

(54) ADJUSTABLE HACKSAW WEIGHT

(76) Inventor: William G. Clark, 2971 Melvin Dr., New Castle, PA (US) 16105

( * ) Notice: Subject to any disclaimer, the term of this patent is extended or adjusted under 35 U.S.C. 154(b) by 30 days.

(21) Appl. No.: 10/187,235

(22) Filed: Jul. 2, 2002

(51) Int. Cl.[7] ..... B27B 21/00
(52) U.S. Cl. ..... 30/514; 30/507
(58) Field of Search ..... 30/514, 517, 522, 30/507, 509

(56) References Cited

U.S. PATENT DOCUMENTS

| | | | | |
|---|---|---|---|---|
| 2,204,390 A | | 6/1940 | Albright | |
| 2,604,910 A | * | 7/1952 | Crosby | |
| 3,840,059 A | | 10/1974 | Ingro | |
| 4,079,763 A | | 3/1978 | Riley | |
| 4,350,067 A | * | 9/1982 | Picard | 83/796 |
| 5,074,002 A | * | 12/1991 | Huang | 30/512 X |
| 5,678,315 A | | 10/1997 | Hartzell | |

FOREIGN PATENT DOCUMENTS

| | | | | |
|---|---|---|---|---|
| FR | 815610 | * | 4/1937 | 30/514 |

* cited by examiner

*Primary Examiner*—Douglas D. Watts
(74) *Attorney, Agent, or Firm*—Harpman & Harpman

(57) ABSTRACT

A hacksaw weight having a pair of axially aligned saw engagement members adjustably secured to one another by an extending threaded support shaft. A threaded engagement-retaining fitting can be selectively positioned on the threaded support shaft with a retaining disk and registration pin positioned thereon for engagement with aligned notches in the respective engagement members. The weight can be selectively secured in multiple positions on both the hacksaw frame and blade.

9 Claims, 5 Drawing Sheets

ADJUSTABLE HACKSAW WEIGHT

BACKGROUND OF THE INVENTION

1. Technical Field

This invention relates to accessories for saws, specifically hacksaws which are characterized by an integral U-shaped frame and handle configuration with a saw blade held in tension there between. Hacksaws are used to cut hard material such as metal wherein concentrated force must be applied by the user during the sawing effort.

2. Description of Prior Art

Prior art devices of this type have relied on saw frame configurations in which a portion of the frame is enlarged or the handle portion of the saw is longitudinally offset in an attempt to improve saw efficiency and ease of use. See for example U.S. Pat. Nos. 2,204,390, 3,840,059, 4,079,763 and 5,678,315.

In U.S. Pat. No. 2,204,390 a hacksaw is disclosed having a handle portion and an adjustable frame portion. A counter weight is threadably secured to the end of the frame portion opposite the handle.

U.S. Pat. No. 3,840,059 is directed to a hacksaw having an offset handle which allows for longitudinal and repositioning adjustments of the handle relative to the blade frame and the blade.

U.S. Pat. No. 4,079,763 discloses a convertible hacksaw having a pair of oppositely disposed handles in incremental adjustments of both the frame length and blade plane with respect to the plane of the handle struts.

A saw handle with repositionable handgrips is illustrated in U.S. Pat. No. 5,678,315 in which an open end handle having a generally J-shape is mounted on a saw so that the engagement plane of the handle is vertically offset in relation to the saw blade plane.

SUMMARY OF THE INVENTION

An adjustable inter-changeable supplemental weight device for use on a hacksaw. The weight device can be reconfigured to be adaptable for locking engagement on the frame and the blade of the hacksaw in multiple positions. The weight device has independent apertured registration jaws with bilateral aligned recesses that are engageable on different dimensional aspects of the saw frame and the blade imparting additional force to the saw.

DESCRIPTION OF THE PREFERRED EMBODIMENT

Figure 1:
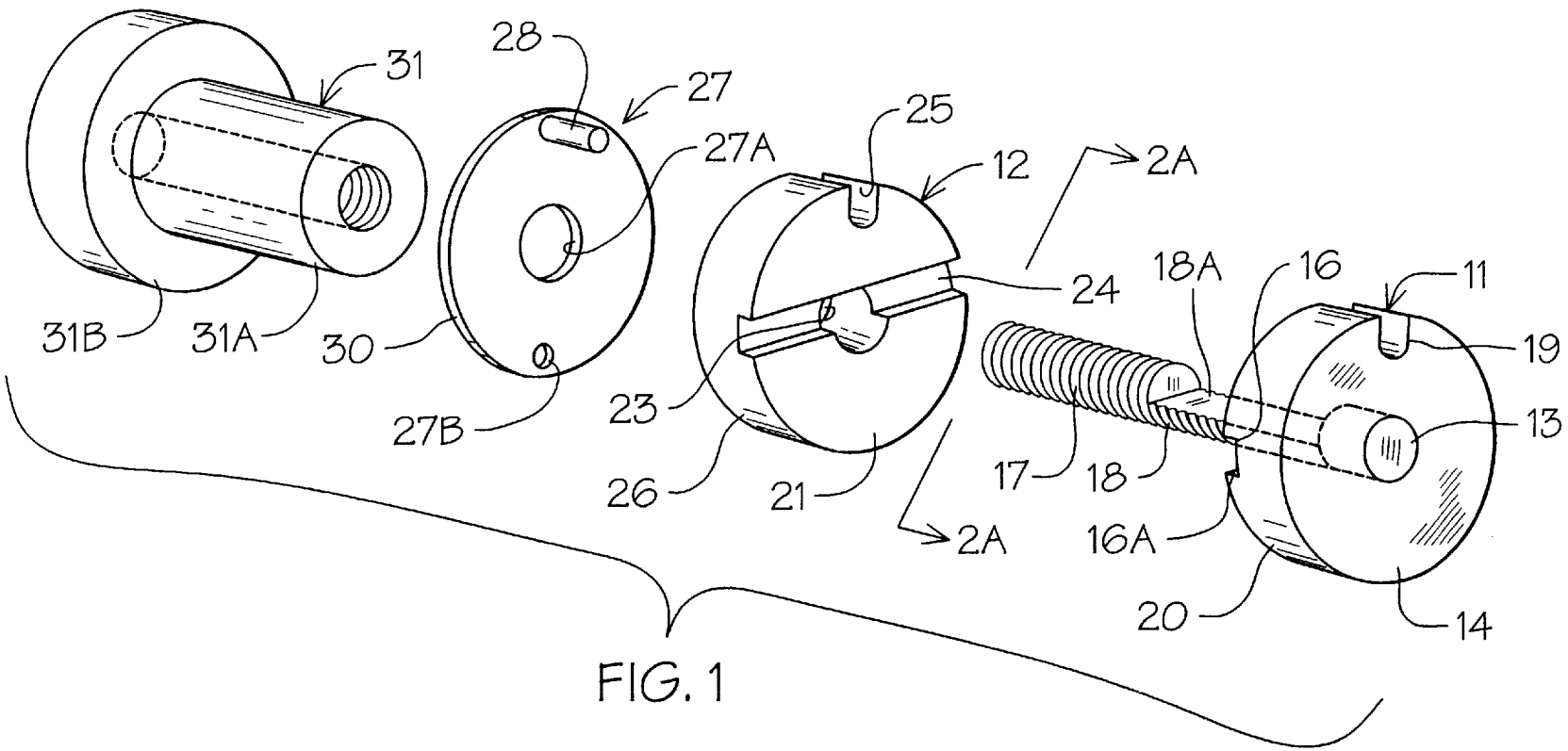
FIG. 1 is an exploded perspective view of the weight device of the invention.
Figure 2:
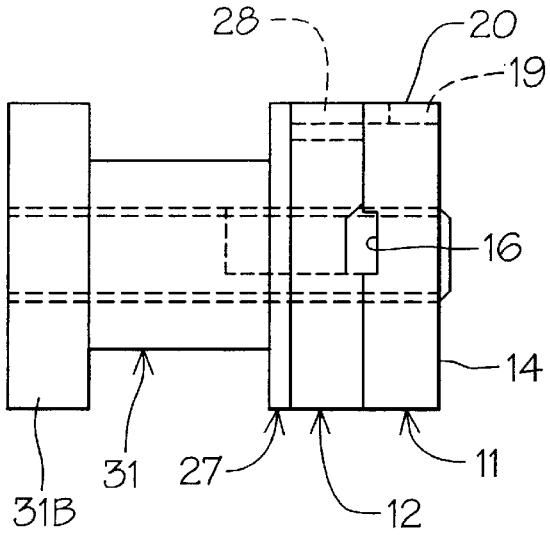
FIG. 2 is a side elevational view of the invention.
Figure 2A:
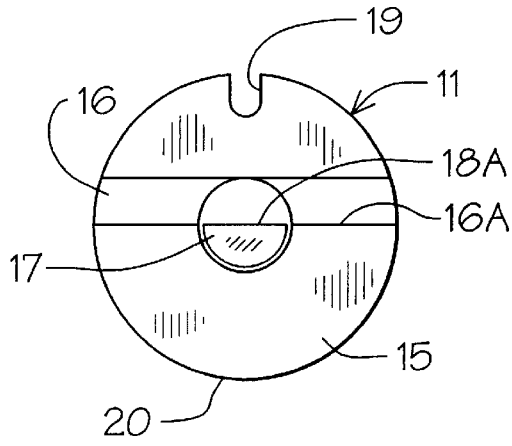
FIG. 2A is an end elevational view of a base portion of the invention on lines 2A of FIG. 1.
Figure 3:
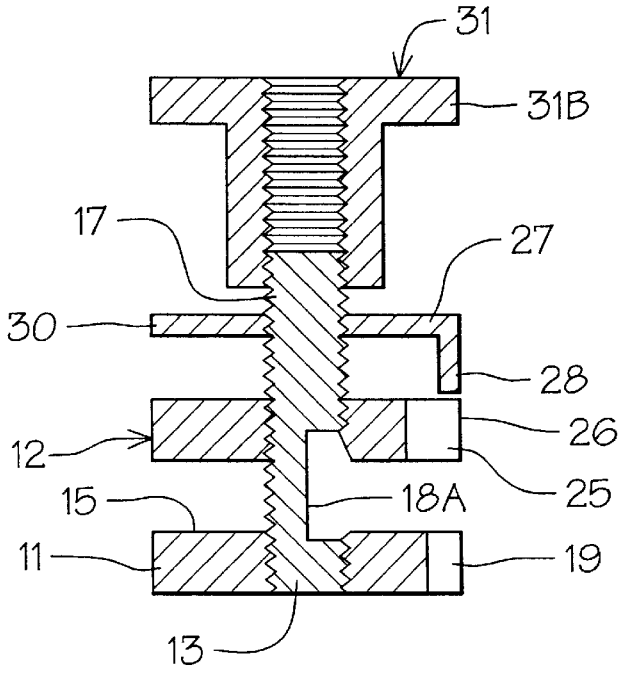
FIG. 3 is a cross-sectional view of the invention in open position.

Referring now to FIGS. 1, 2 and 3 of the drawings, a saw weight 10 can be seen having a base member 11, and an oppositely disposed engagement member 12. The base member 11 is of a disk configuration having a central internally threaded aperture at 13 therein. The base member 11 has an outer surface 14 and an interengagement face 15 with a registration slot at 16 extending across the engagement face 15 intersecting a portion of the aperture at 13 as best seen in FIG. 2A of the drawings. A threaded shaft 17 extends from the aperture at 13 having an area of reduced transverse dimension at 18 extending from within the slot 16 to a point midway the exposed length of the shaft 17 emanating there from. A surface 18A of the reduced transverse area 18 is co-planar with that of an inner edge 16A of the slot 16 as hereinbefore described. A notch 19 is formed within the perimeter edge 20 of the base 11 opposite the area of reduced transverse dimension at 18.

Figure 7:
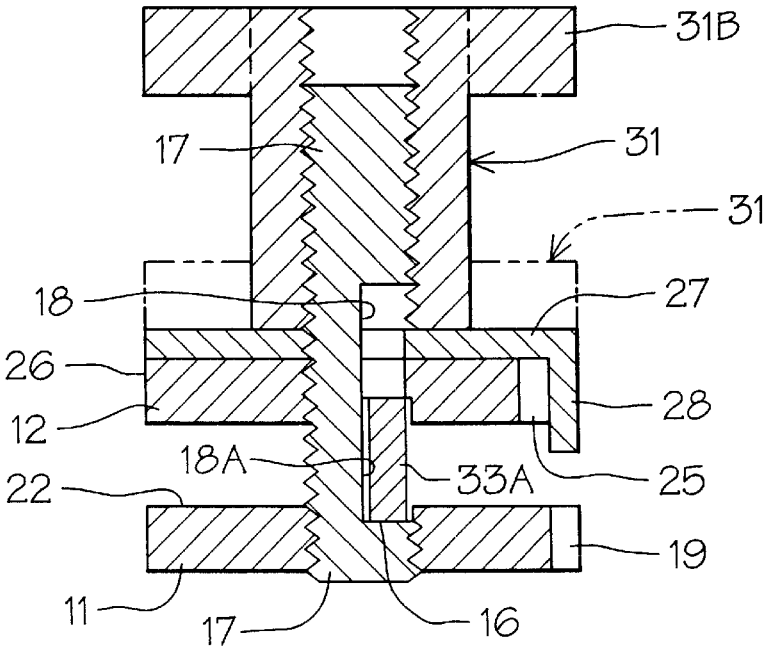
FIG. 7 is an enlarged cross-sectional view of the invention attached to the frame portion of a hacksaw.

The engagement member 12 is also of a disk shape having an inner engagement surface 21 and an outer engagement face 22 with a central opening at 23 therein. A secondary slot 24 extends off center across the inner engagement surface 21 intersecting a portion of the central opening 23. A secondary notch 25 extends inwardly from a perimeter edge 26 of the engagement member 12, as best seen in FIG. 7 of the drawings.

An alignment disk 27 can be seen having a central aperture at 27A and a pin 28 extending there from. The pin 28 is adjacent a perimeter edge 30 so as to be aligned with and registerable through the notch 25 in the engagement member 12 and partially within the notch 19 in the base 11 when the engagement disk 12 and retaining disk 27 are positioned on the shaft 17 as illustrated in FIG. 2 of the drawings.

A secondary aperture at 27B is formed within the retaining disk 27 inwardly of the perimeter edge 30. A retaining fitting 31 has an internally threaded sleeve portion 31A and integrally apertured internally threaded disk portion 31B. The retaining fitting 31 is threadably engaged on the free end of the shaft 17 that extends through the respective aligned central openings in the retaining disk 27 and engagement member 12 as hereinbefore described and as best seen and indicated for registration in FIG. 3 of the drawings.

In operation and use, the saw weight 10 of the invention can be positioned on a hacksaw 32 in multiple positions as illustrated in FIGS. 4–8 of the drawings. The hacksaw 32 has a telescopically extensible frame member 33 secured to a handle portion 34 with respective blade mounting insert depending arms 35 and 36 as will be well known and understood by those skilled in the art. An adjustable blade 37 is secured between the ends of the arms 35 and 36 by blade engagement fittings 35A and 36A respectively.

Figure 4:
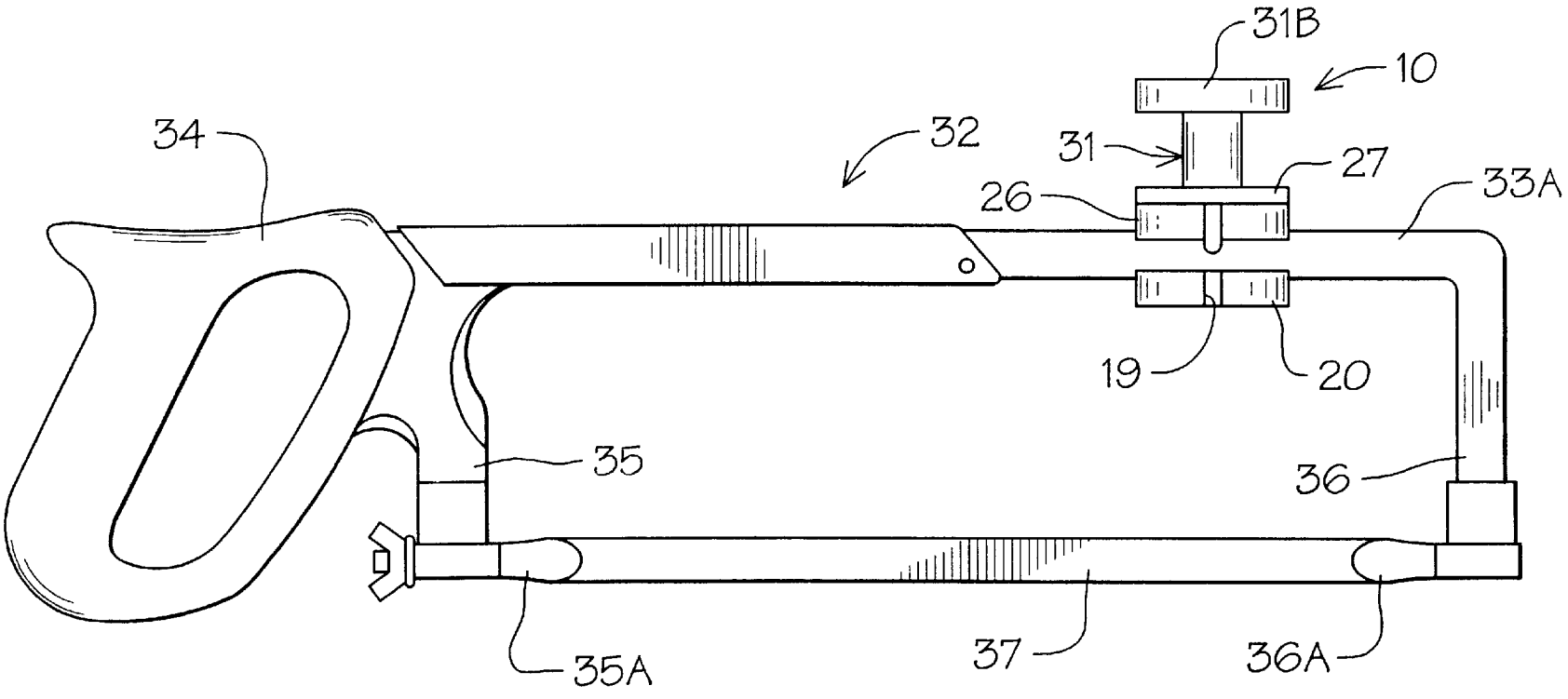
FIG. 4 is a side elevational view of the invention positioned on a hacksaw.

Referring now to FIG. 4 of the drawings, the saw weight 10 of the invention is shown positioned on the extended portion 33A of the frame member 33. The frame portion 33A is engaged between the respective slots 16 and 24 as illustrated in FIG. 8 of the drawings by threadably advancing the retaining fitting 31 on the shaft 17 and advancing to contact with the retainer disk 27 as hereinbefore described. It should be noted that the retaining fitting 31 has a universal thread so that it can be reversed and threadably mounted on the shaft 17 as indicated in broken lines in FIG. 8.

Figure 5:
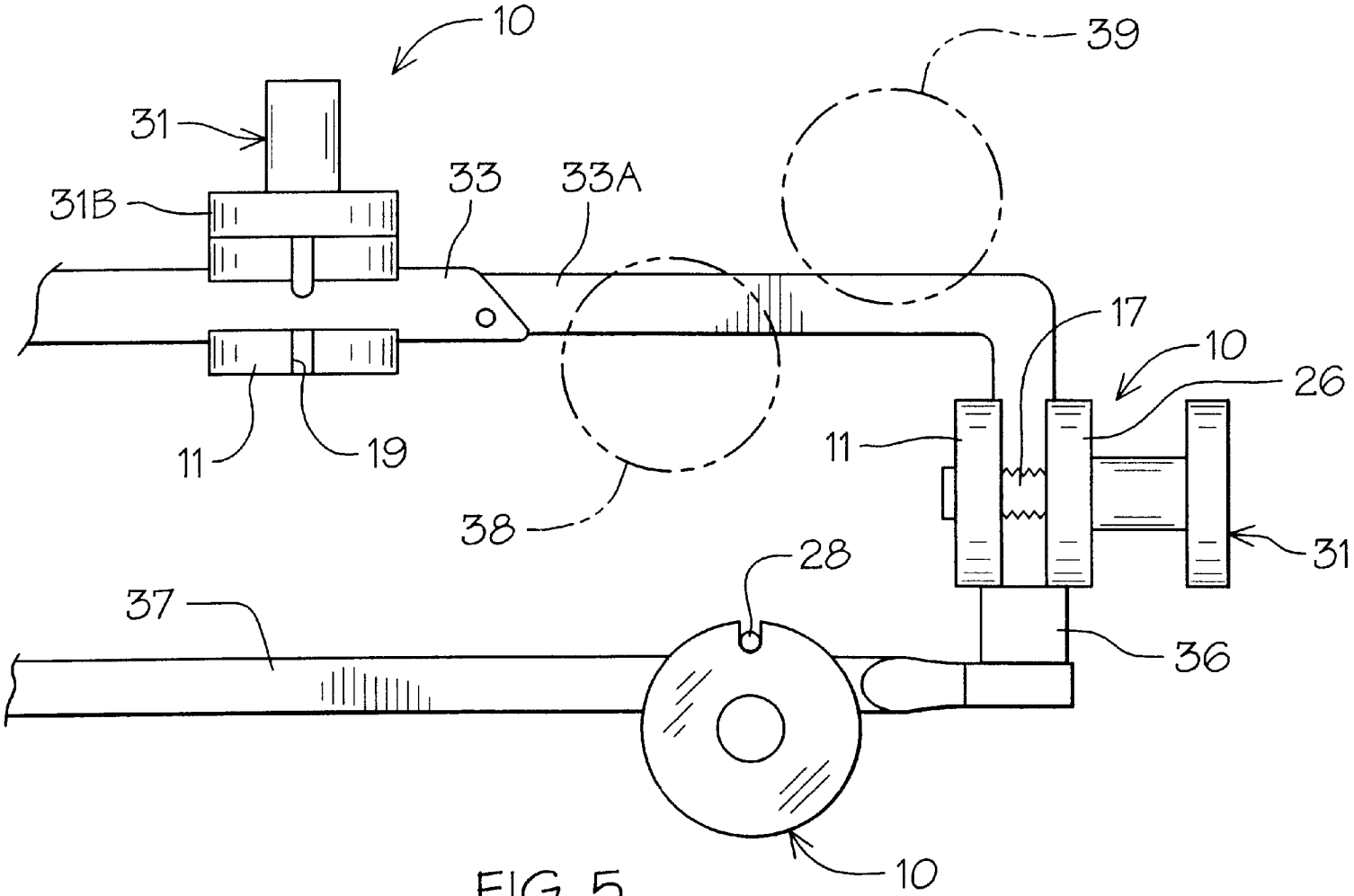
FIG. 5 is a partial side elevational view of a hacksaw illustrating alternate attachment positions of the invention thereon.
Figure 6:
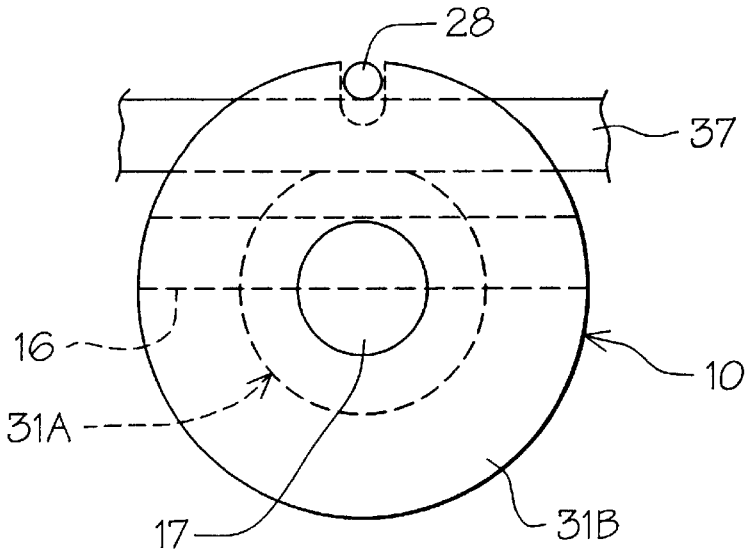
FIG. 6 is a side elevational view of the invention on a blade portion of a hacksaw with portions broken away.

Referring now to FIGS. 5, 6 and 7 of the drawings, the saw weight 10 is mounted on the saw blade 37 wherein the opposing engagement face 15 and the inner engagement face 21 of the respective base 11 and engagement member 12 are registerable on the blade 37. Additionally, it will be seen that the retaining pin 28 will extend across the opening between the respective elements so as to abut the saw blade 37 preventing the saw weight 10 from dropping off the blade 37 as best seen in FIGS. 6 and 7 of the drawings.

Given the versatility of the saw weight 10, it can also be mounted to the hacksaw 32 in a variety of other positions graphically illustrated in broken lines at 38, 39 and 40 in FIG. 5 of the drawings depending on the nature of the hacksaw used and the requirement.

Other alternate mounting configurations can also be achieved as illustrated at 41 in FIG. 5 of the drawings and at 42 in FIG. 4 of the drawings in which the retaining fitting 31 has been thoroughly revised as hereinbefore described.

It will be evident from the above description that while the saw weight 10 is preferably made of metal, other materials or combinations of same can be used in a laminated configuration, for example, to achieve the same structural configuration.

It will be apparent to those skilled in the art that various changes and modifications may be made therein without departing from the spirit of the invention.

Therefore I claim:

1. An adjustable saw weight for use on hacksaws, the saw weight comprises, a pair of centrally apertured opposing jaw elements interconnected by a central support shaft, each of said jaw elements having a material engagement slot within their respective opposing faces, said engagement slots intersecting a portion of said center openings therein, an aperture engagement disk aligned on said central support shaft against one of said jaw elements, alignment means extending from said engagement disk registerable within corresponding alignment means in said respective jaw elements, a retaining fitting threadably engaged on the free end of said support shaft.

2. The adjustable saw weight set forth in claim 1 wherein said jaw elements are metallic disks.

3. The adjustable saw weight set forth in claim 1 wherein said central support shaft extends from one of said jaw elements and has an area of reduced transverse dimension extending from one of said jaw elements.

4. The adjustable saw weight set forth in claim 1 wherein said central support shaft is threaded.

5. The adjustable saw weight set forth in claim 1 wherein said respective engagement slots are off center in relation to said openings in said respective jaw elements.

6. The adjustable saw weight set forth in claim 1 wherein said alignment means extending from said aperture engagement disks comprises a pin.

7. The adjustable saw weight set forth in claim 1 wherein said corresponding alignment means in said jaw elements comprises a first notch in said adjustment jaw element and a second notch in said remaining jaw element.

8. The adjustable saw weight set forth in claim 7 wherein said first notch is of a known depth and said second notch is of a depth less than that of said first notch.

9. The adjustable saw weight set forth in claim 1 wherein said retaining fitting is threadably engaged on said support shaft in either longitudinal direction.

* * * * *